US011298594B1

(12) United States Patent
Wan

(10) Patent No.: US 11,298,594 B1
(45) Date of Patent: Apr. 12, 2022

(54) GOLF BALL SCRIBER

(71) Applicant: Kevin Wan, La Jolla, CA (US)

(72) Inventor: Kevin Wan, La Jolla, CA (US)

( * ) Notice: Subject to any disclaimer, the term of this patent is extended or adjusted under 35 U.S.C. 154(b) by 0 days.

(21) Appl. No.: 17/207,084

(22) Filed: Mar. 19, 2021

(30) Foreign Application Priority Data

Dec. 18, 2020 (CN) ..... 202011506407.3

(51) Int. Cl.
*A63B 45/02* (2006.01)
*B41F 17/30* (2006.01)
*A63B 53/04* (2015.01)

(52) U.S. Cl.
CPC ..... *A63B 45/02* (2013.01); *B41F 17/30* (2013.01); *A63B 53/0441* (2020.08)

(58) Field of Classification Search
CPC ..... A63B 45/02
USPC ..... 101/35
See application file for complete search history.

(56) References Cited

U.S. PATENT DOCUMENTS 6,379,271 B1 * 4/2002 Arnke ..... A63B 57/20 473/406
6,676,544 B2 * 1/2004 Tyke ..... A63B 43/008 101/127.1
8,191,276 B1 * 6/2012 Yi ..... A63B 45/02 33/562
8,627,768 B2 * 1/2014 Smith ..... B43L 13/208 101/35
2007/0021231 A1 * 1/2007 Rutherford ..... A63B 69/3688 473/280
2007/0197309 A1 * 8/2007 Geraty ..... A63B 69/3655 473/257
2010/0095858 A1 * 4/2010 Krikorian ..... A63B 43/008 101/35
2014/0119807 A1 * 5/2014 Tarlow ..... B43K 29/005 401/6
2015/0075395 A1 * 3/2015 Liao ..... B41F 17/30 101/35
2018/0082036 A1 3/2018 Barrett

FOREIGN PATENT DOCUMENTS

KR 10-2015-0068736 6/2015
KR 20-0486405 5/2018

* cited by examiner

*Primary Examiner* — Anthony H Nguyen
(74) *Attorney, Agent, or Firm* — F. Chau & Associates, LLC

(57) ABSTRACT

A golf ball scriber includes: a clip comprising a first clip body and a second clip body which are connected by a pivot shaft; a clamping groove surface disposed on an inner clamping surface of the clip; a sealed brush device; a first clip groove and a second clip groove symmetrically arranged on a respective outer wall of the first clip body and the second clip body; a scribing ruler disposed at a bottom surface of the first clip groove; a strip-shaped chamfered groove disposed on the scribing ruler away from the clamping groove surface; and a strip-shaped scribing groove disposed on the chamfered groove which corresponds to the clamping groove surface, wherein the scribing ruler, the chamfered groove, and the scribing groove share a central line, and the brush device is in sliding connection with the first clip groove disposed on the first clip body.

18 Claims, 14 Drawing Sheets

GOLF BALL SCRIBER

CROSS-REFERENCE TO RELATED APPLICATION

This U.S. non-provisional patent application claims priority under 35 U.S.C. § 119 to Chinese patent application 202011506407.3, filed on Dec. 18, 2020, in the China National Intellectual Property Administration (CNIPA), the entire disclosure of which is incorporated by reference herein in its entirety.

TECHNICAL FIELD

The patent disclosure relates to a golf ball equipment, and more particularly, to a golf ball scriber.

DISCUSSION OF THE RELATED ART

Golf is a popular sport and golf players depend on scribed lines on a spherical surface of a golf ball to make precise and high-quality shots. A golf ball scribing device or a line marker may be used to scribe or mark lines on the spherical surface of the golf ball. Additionally, ink used to scribe lines should be dried fast and water cannot easily scrub such ink.

Existing golf ball scribing devices do not include an ink pen or a brush device for scribing. For example, a user carries both a golf ball scribing device and a separate ink pen, which is used to mark lines on the golf ball. This is not convenient for the user and the ink pen may be easily misplaced. Additionally, ink pen may be easily dried up without proper sealing mechanisms and the service lifetime of the ink pen is thus decreased.

SUMMARY

One or more embodiments of the present disclosure provide a golf ball scriber that integrates a brush device, which also has an increased sealing performance. As a result, a pen nib of the brush device is maintained wet due to the increased sealing performance and the brush device has a relatively long service duration.

According to an embodiment of the inventive concept, a golf ball scriber may include: a clip comprising a first clip body and a second clip body which are connected by a pivot shaft; a clamping groove surface disposed on an inner clamping surface of the clip; a sealed brush device; a first clip groove and a second clip groove symmetrically arranged on a respective outer wall of the first clip body and the second clip body; a scribing ruler disposed at a bottom surface of the first clip groove; a strip-shaped chamfered groove disposed on the scribing ruler away from the clamping groove surface along a radial direction of the clip; and a strip-shaped scribing groove disposed on the chamfered groove which corresponds to the clamping groove surface, wherein the scribing ruler, the chamfered groove, and the scribing groove may share a central line, and wherein the brush device may be in sliding connection with the first clip groove disposed on the first clip body.

In an embodiment of the inventive concept, the brush device of the golf ball scriber may include a U-shaped scribing track, a circular ink tank having a cylinder, a pen case having a pen core, a sealing cover, wherein the circular ink tank, the U-shaped scribing track, the pen case, and the sealing cover may be sequentially connected from top to bottom, and wherein the U-shaped scribing track may be connected to the first clip groove; an upper part of the pen core configured to pass through the cylinder and enter the circular ink tank; and a lower part of the pen core configured to pass through the pen case and enter the sealing cover for sealing.

In an embodiment of the inventive concept, the cylinder may be disposed in the pen case and an upper part of the pen case passes through an I-shaped scribing guide sleeve and may be adjacent to a lower end surface of the circular ink tank, wherein a lower part of the pen case may pass through a spring and may be disposed at an upper end of the sealing cover, wherein the sealing cover may be disposed in the first clip groove, and the I-shaped scribing guide sleeve may be clamped on the U-shaped scribing track, and wherein as the I-shaped scribing guide sleeve may slide on the U-shaped scribing track to the scribing groove, a pen nib of the pen core may pass through the scribing groove to scribe a spherical surface of a golf ball.

In an embodiment of the inventive concept, a clamping hole clamped with the sealing cover may be disposed at the bottom of the first clip groove, and the clamping hole may be located at one end of the chamfered groove, wherein the clamping hole and the chamfered groove may share a same central line, wherein a No. 1 mortise may be disposed on each of two symmetrical side walls in the first clip groove along an axial direction of the clip, and wherein the No. 1 mortise may be adapted to a No. 1 tenon disposed on the sealing cover.

In an embodiment of the inventive concept, at least two No. 2 mortises arranged at equal intervals may be disposed on each of two symmetrical side walls in the first clip groove along the axial direction of the clip, wherein the at least two No. 2 mortises may be arranged along the radial direction of the clip, wherein a No. 2 tenon may be disposed on each of two outer walls of the U-shaped scribing track along the radial direction of the clip, and the No. 2 tenon may be adapted to each of the at least two No. 2 mortises, wherein a clamping block may be arranged in the middle of a side wall of the clamping hole in the first clip groove, and a No. 3 mortise may be symmetrically arranged at both ends of the clamping block, and wherein the clamping block may be clamped in a bayonet of the U-shaped scribing track, and a No. 3 tenon may be symmetrically arranged at both ends of the bayonet on the U-shaped scribing track, and the No. 3 tenon may be adapted to the No. 3 mortise.

In an embodiment of the inventive concept, a clamping groove may be disposed on a side surface of the sealing cover which connects a side wall having the No. 3 mortise, and wherein the clamping groove is adapted to a lower part of the clamping block.

In an embodiment of the inventive concept, a silicon strand groove may be disposed on an upper end surface of the sealing cover and the silicon strand groove is adapted to a No. 1 sealing silicon strand, and wherein a conical clamping cylinder may be disposed in the silicon strand groove and the conical clamping cylinder is adapted to the clamping hole.

In an embodiment of the inventive concept, the circular ink tank may include a silicon strand plug, an ink box cover having a plug hole, an ink tank body, and the silicon strand plug may be adapted to the plug hole, wherein the lower part of an ink tank cover may be configured to be screwed into the ink tank body, and a No. 1 accommodating cavity configured to accommodate ink is formed between the ink box cover and the ink tank body, wherein the cylinder may be connected to and may communicate with the bottom end surface of the ink tank body, and an outer upper part of the cylinder may be provided with an outer thread, and wherein an upper end surface of the pen case may be disposed adjacent to a low end surface of the ink tank body.

In an embodiment of the inventive concept, the pen case may be configured to be hollow cylindrical inside, and an inner thread connected with an upper thread of the cylinder may be disposed on an inner wall of the upper part of the pen case, wherein a circular limiting table may be disposed on an outer wall of the lower part of the pen case and the circular limiting table may be flush with a bottom end surface of the pen case, and wherein the lower part of the spring may be configured to be restrained on the circular limiting table.

In an embodiment of the inventive concept, the brush device may include a U-shaped scribing track and a clamping table, and the clamping table may be disposed on one end of the U-shaped scribing track.

In an embodiment of the inventive concept, a height of the clamping table may be higher than a height of a portion of the U-shaped scribing track.

According to an embodiment of the inventive concept, a golf ball scriber may include: a clip comprising a first clip body and a second clip body which may be connected by a pivot shaft; a clamping groove surface disposed on an inner clamping surface of the clip; a sealed brush device; and a first clip groove and a second clip groove symmetrically arranged on a respective outer wall of the first clip body and the second clip body, wherein the brush device may be in sliding connection with the first clip groove disposed on the first clip body.

In an embodiment of the inventive concept, the golf ball scriber may further include a scribing ruler disposed at a bottom surface of the first clip groove; a strip shaped chamfered groove disposed on the scribing ruler away from the clamping groove surface along a radial direction of the clip; and a strip-shaped scribing groove disposed on the chamfered groove which corresponds to the clamping groove surface.

In an embodiment of the inventive concept, the scribing ruler, the chamfered groove, and the scribing groove share a central line, and the brush device includes a No. 2 sealing silicon strand disposed on an upper part of a sealing cover, and the No. 2 sealing silicon strand comprises an outer silicon strand body and an inner silicon strand body.

In an embodiment of the inventive concept, the inner silicon strand body may be vertically arranged along a lower end of the outer silicon strand body facing its interior, wherein a No. 2 accommodating cavity configured to accommodate a lower part of a pen case may be disposed between the outer silicon strand body and the inner silicon strand body, wherein the inner silicon strand body may be configured a hollow structure and is configured coaxial with the outer silicon strand body, and an upper part of the inner silicon strand body may be disposed between a cylinder and the pen case, and wherein a pen core may penetrate through the lower part of the inner silicon strand body and enters the sealing cover for sealing.

In an embodiment of the inventive concept, an arc-shaped opening may be disposed in the inner silicon strand body along its radial direction, and an arc-shaped bump may be disposed on an inner wall of the pen case and the arc-shaped bump may be adapted to the arc-shaped opening.

According to an embodiment of the inventive concept, a brush device may include: a U-shaped scribing track, a circular ink tank having a cylinder, a pen case having a pen core, a sealing cover, wherein the circular ink tank, the U-shaped scribing track, the pen case, and the sealing cover may be sequentially connected from top to bottom; an upper part of the pen core configured to pass through the cylinder and enter the circular ink tank; and a lower part of the pen core configured to pass through the pen case and enter the sealing cover for sealing.

In an embodiment of the inventive concept, wherein the cylinder may be disposed in the pen case and an upper part of the pen case may pass through an I-shaped scribing guide sleeve and may be adjacent to a lower end surface of the circular ink tank, wherein a lower part of the pen case may pass through a spring and may be disposed at an upper end of the sealing cover, and wherein the I-shaped scribing guide sleeve may be clamped on the U-shaped scribing track.

BRIEF DESCRIPTION OF THE DRAWINGS

Example embodiments will be described in greater detail hereinafter with reference to the accompanying drawings. In the accompanying drawings, dimensions may be exaggerated for clarity of illustration. It will be understood that when an element is referred to as being "between" two elements, it may be the only element between the two elements, or one or more intervening elements may also be present between the two elements.

The above and other features of the inventive concept will become more apparent by describing in detail example embodiments thereof with reference to the accompanying drawings, in which.

DETAILED DESCRIPTION OF THE EMBODIMENTS

Figure 1:
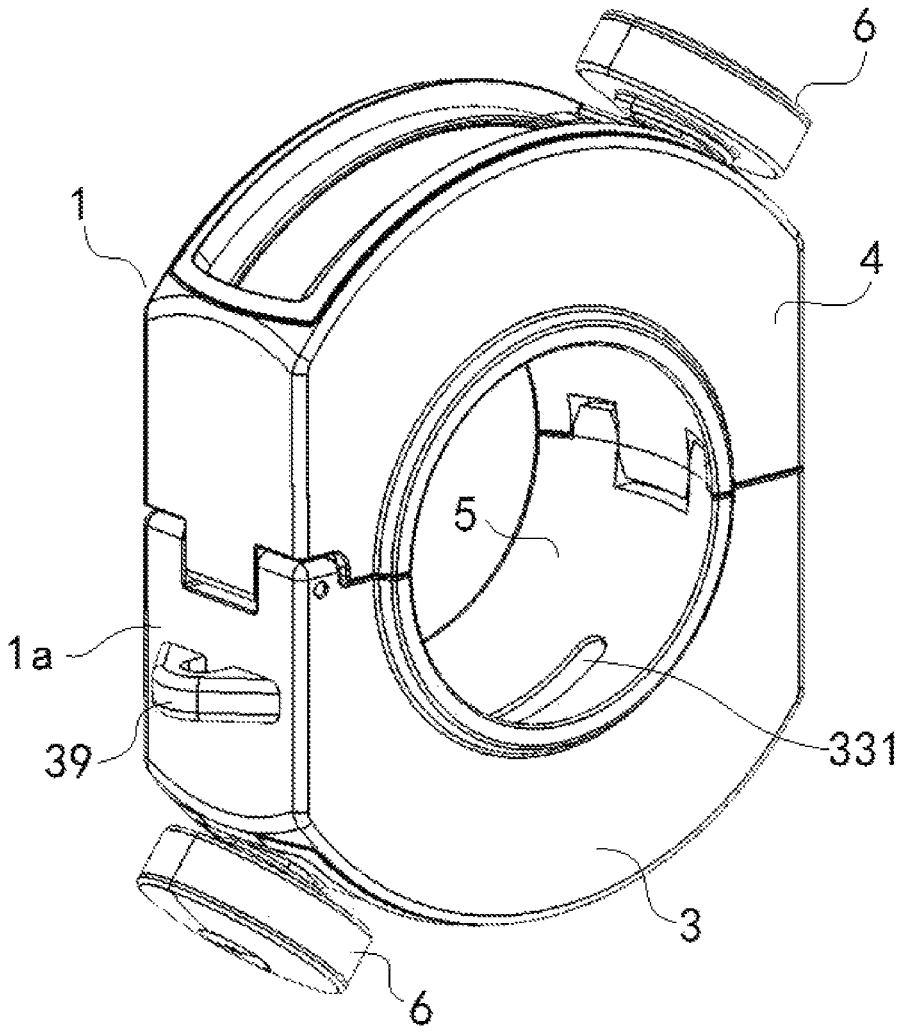
FIGS. 1 and 2 are schematic diagrams illustrating a three-dimensional (3D) structure of a golf ball scriber from different viewpoint perspectives in accordance with embodiments of the present disclosure.

Like reference numerals may refer to like elements throughout this specification. In the figures, the thickness of lines, layers, components, or films or regions may be exaggerated for clarity. The term "and/or" includes any and all combinations of one or more of the associated listed items.

It will be understood that although the terms such as "first" and "second" are used herein to describe various elements, these elements should not be limited by these terms. The terms are only used to distinguish one component from other components. For example, a first element referred to as a first element in one embodiment may be referred to as a second element in another embodiment without departing from the scope of the appended claims. The singular forms, "a", "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence and/or addition of one or more other features, integers, steps, operations, elements, components, and/or groups thereof.

Also, "under", "below", "above', "upper", and the like are used for explaining relational association of components or elements illustrated in the drawings. The terms are intended to be a relative concept and are described based on directions as illustrated in the drawings.

Here, it will be understood that when an element or layer is referred to as being "on", "connected", or "coupled to" another element or layer, it can be directly on, connected or coupled to the another element or layer, or one or more intervening elements may be present.

Hereinafter, example embodiments of the present disclosure will be described in detail with reference to the accompanying drawings.

Figure 2:
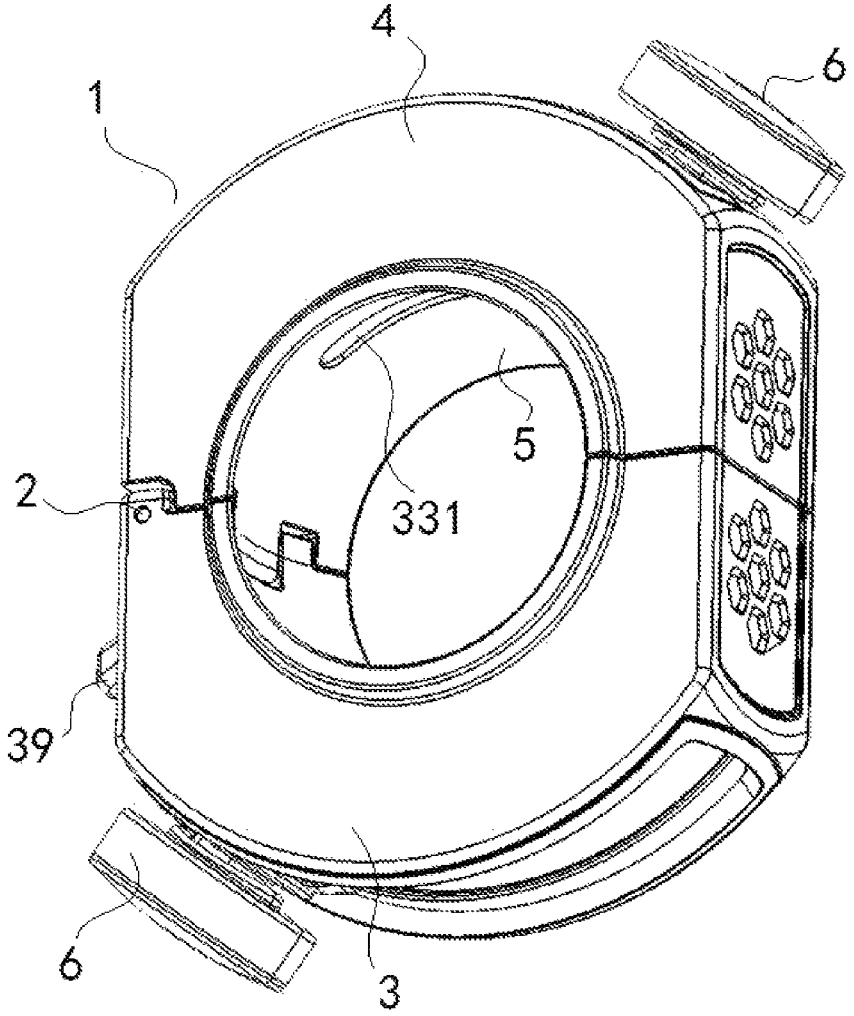
Figure 3:
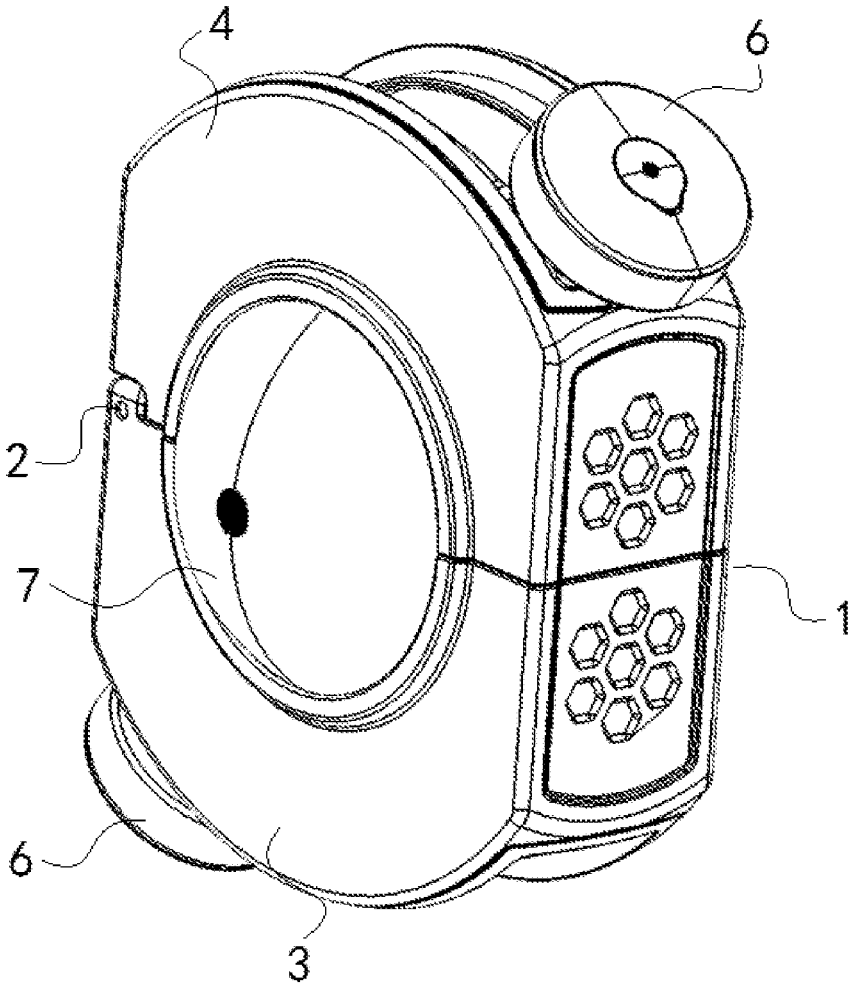
FIG. 3 is a schematic diagram illustrating a 3D structure in which a golf ball is installed inside a golf ball scriber in accordance with embodiments of the present disclosure.

FIGS. 1 and 2 are schematic diagrams illustrating a three-dimensional (3D) structure of a golf ball scriber from different viewpoint perspectives in accordance with embodiments of the present disclosure. FIG. 3 is a schematic diagram illustrating a 3D structure in which a golf ball is installed inside a golf ball scriber in accordance with embodiments of the present disclosure. Referring to FIGS. 1 and 2, a golf ball scriber may include a clip 1, wherein the clip 1 may include a first clip body 3 and a second clip body 4. The first clip body 3 and the second clip body 4 are connected by a pivot shaft 2 (as shown in FIG. 2).

According to an embodiment, a clamping groove surface 5 may be disposed on an inner surface of the first clip body 3. A substantially similar clamping groove surface 5 may also be disposed on an inner surface of the second clip body 4. The clamping groove surface 5 may face a golf ball.

Referring to FIG. 3, an inner clamping surface of the clip 1 has a clamping groove surface 5 (see FIG. 2) which is matched with the spherical surface of a golf ball 7. The golf ball 7 may fit tightly in between the first clip body 3 and the second clip body 4. The spherical surface of the golf ball may be at least partially surrounded by an inner surface of the first clip body 3 and an inner surface of the second clip body 4.

According to an embodiment, the golf ball scriber may include a brush device 6 disposed on an outer surface of the first clip body 3. A substantially similar brush device 6 may be disposed on an outer surface of the second clip body 4.

Figure 4:
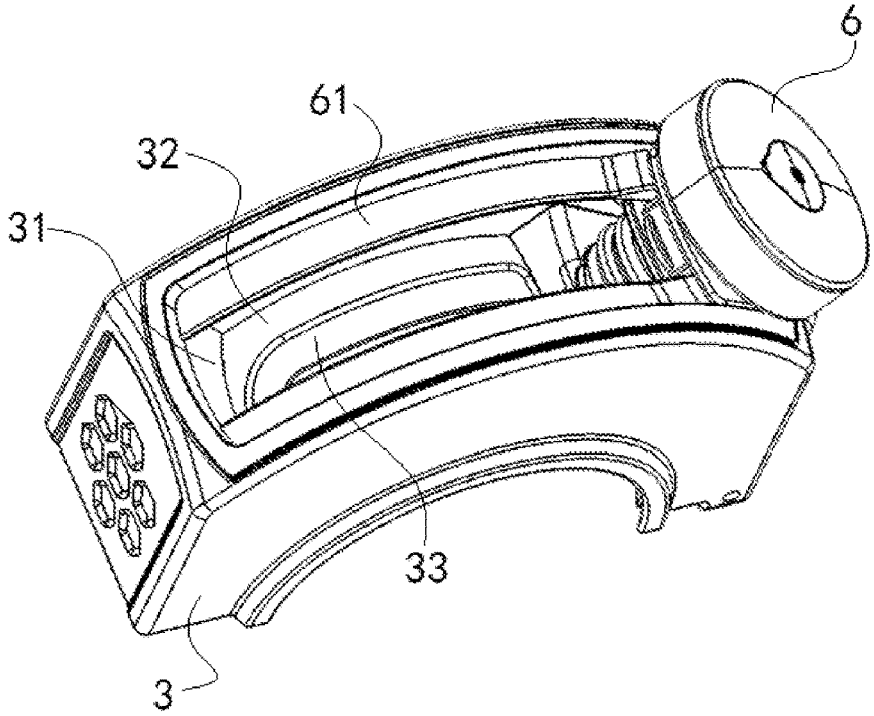
FIG. 4 is a schematic diagram illustrating a 3D structure of a first clip body in accordance with embodiments of the present disclosure.

FIG. 4 is a schematic diagram illustrating a 3D structure of a first clip body in accordance with embodiments of the present disclosure. According to an embodiment, the first clip body 3 may include a clip groove 31, a scribing ruler 32, a strip-shaped chamfered groove 33, a U-shaped scribing track 61, and a brush device 6. The second clip body 4 may also include a clip groove 31, a scribing ruler 32, a strip-shaped chamfered groove 33, a U-shaped scribing track 61, and a brush device 6. In some cases, the scribing ruler 32 may also be referred to as a scribing scale.

To the extent that a description of an element has been omitted, it may be assumed that the description is at least similar to that of corresponding elements that have been described elsewhere in the instant specification.

According to an embodiment, the clip groove 31 may be disposed on an outer wall of the first clip body 3. A substantially similar clip groove 31 may be disposed on an outer wall of the second clip body 4. In some examples, the clip groove 31 disposed on the outer wall of the first clip body 3 may be referred to as a first clip groove 31. Similarly, the clip groove 31 disposed on the outer wall of the second clip body 4 may be referred to as a second clip groove 31.

According to an embodiment, the clip grooves 31 may be symmetrically disposed on a respective outer wall of the first clip body 3 and the second clip body 4. The scribing ruler 32 may be disposed at the bottom of the clip groove 31. The strip-shaped chamfered groove 33 may be disposed on the scribing ruler 32. The strip-shaped chamfered groove 33 may be spaced apart or disposed away from a clamping groove surface 5 along the radial direction of the clip 1. A strip-shaped scribing groove 331 may be disposed on the chamfered groove 33 which corresponds to the clamping groove surface 5. The scribing ruler 32, the strip-shaped chamfered groove 33 and the scribing groove 331 may share a same center line. In some embodiments of the present inventive concept, the scribing ruler 32 may also be referred to as a scribing ruler 32.

According to an embodiment, the first clip body 3 may include a brush device 6 which is in sliding connection with the clip groove 31 disposed on the first clip body 3. Referring back to FIG. 1, the second clip body 4 includes a substantially similar brush device 6. The brush device 6 may be in sliding connection with the clip groove 31 disposed on the second clip body 4.

According to an embodiment, when the brush device 6 is scribing, due to structure of the strip-shaped chamfered groove 33, friction of the brush device 6 is reduced and its duration of service life is prolonged.

Figure 5:
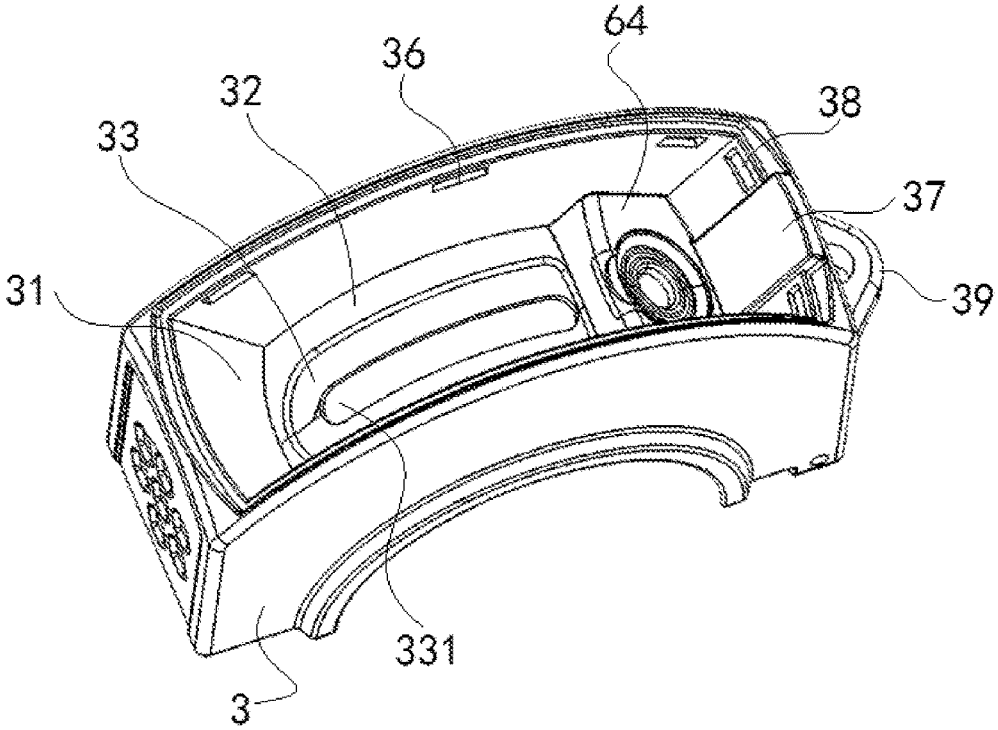
FIG. 5 is schematic diagram illustrating a 3D structure of the structure shown in FIG. 4 with No. 2 sealing silicon strand implemented in a first clip body in accordance with embodiments of the present disclosure.
Figure 6:
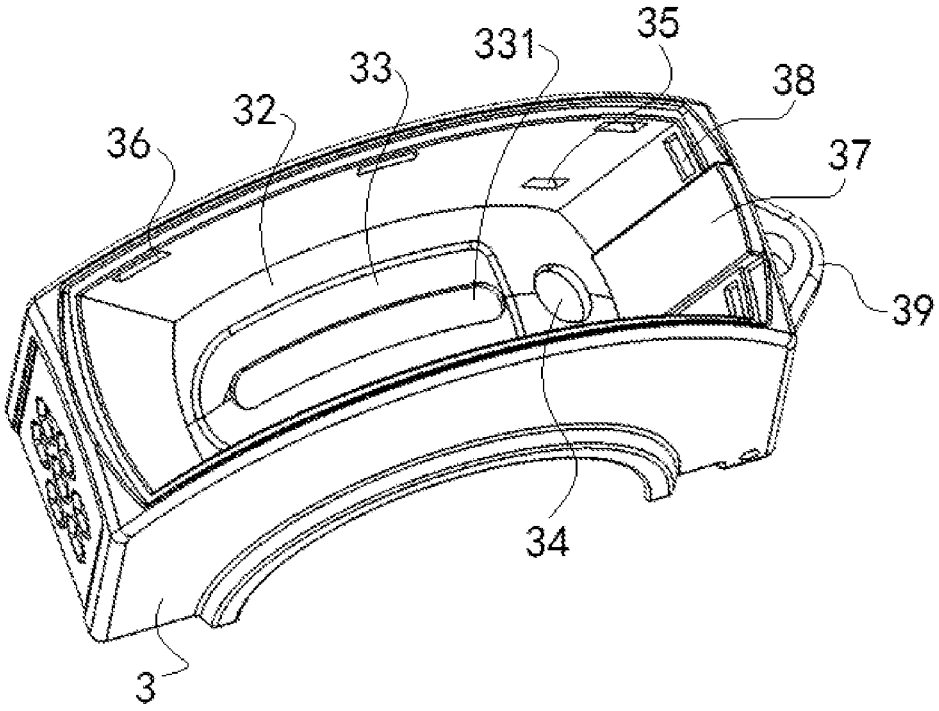
FIG. 6 is a schematic diagram of a 3D structure of a first clip body without a brush device implemented in accordance with embodiments of the present disclosure.

FIG. 5 is schematic diagram illustrating a 3D structure of the structure shown in FIG. 4 with a No. 2 sealing silicon strand installed in the first clip body in accordance with embodiments of the present disclosure. FIG. 6 is a schematic diagram of a 3D structure of a first clip body without a brush device implemented therein in accordance with embodiments of the present disclosure.

As illustrated in FIGS. 5 and 6, a clamping hole 34 which is clamped with the sealing cover 64 may be disposed at the bottom of the clip groove 31, and the clamping hole 34 may be disposed at one end of the chamfered groove 33. The clamping hole 34 share a same central line with the chamfered groove 33.

According to an embodiment, a No. 1 mortise 35 may be disposed on each of two symmetrical side walls which are disposed inside the clip groove 31 along the axial direction of the clip 1. The No. 1 mortise 35 may be adapted to a No. 1 tenon 641 disposed on the sealing cover 64.

According to an embodiment, at least two No. 2 mortises 36 may be arranged at equal intervals and disposed on each of two symmetrical side walls inside the clip groove 31 along the axial direction of the clip 1, and the No. 2 mortises 36 may be arranged along the radial direction of the clip 1.

According to an embodiment, a No. 2 tenon 611 may be disposed on each of two outer walls of the U-shaped scribing track 61 along the radial direction of the clip 1. The No. 2 tenon 611 may be adapted to the No. 2 mortise 36. For example, a size/type of the No. 2 tenon 611 may match with a size/type of the No. 2 mortise 36. The No. 2 mortise 36 may be disposed at the upper part of the No. 1 mortise 35. In this way, the sealing cover 64 is located at the lower part of the U-shaped scribing track 61.

According to an embodiment, when a pen core 631 is separated from the sealing cover 64, the pen core 631 may be displaced on the U-shaped scribing track 61. At the same time, under the compression of the spring 66, a pen nib of the pen core 631 may enter the scribing groove 331 to scribe the spherical surface of the golf ball 7.

As shown in FIGS. 5 and 6, the clamping block 37 may be disposed in the middle of the side wall on the side of the clamping hole 34 in the clip groove 31. According to an embodiment, a No. 3 mortise 38 may be symmetrically arranged at each end of the clamping block 37, so that the clamping block 37 is clamped in a bayonet 612 of the U-shaped scribing track 61. A No. 3 tenon 613 may be symmetrically arranged at each end of bayonet 612 on the U-shaped scribing track 61. The No. 3 tenon 613 may be adapted to the No. 3 mortise 38. For example, a size/type of the No. 3 tenon 613 may match with a size/type of the No. 3 mortise 38.

Furthermore, according to one or more embodiments, the U-shaped scribing track 61 may be fixed on the first clip body 3 such that the brush device 6 is connected to the clip 1. A same U-shaped scribing track 61 may be fixed on the second clip body 4. A same brush device 6 may be disposed on the second clip body 4.

According to an embodiment, the rails on both sides of the bayonet 612 maybe symmetrically provided with clamping tables 614 for clamping the I-shaped scribing guide sleeve 65. An upper end surface of the clamping table 614 may be higher than an upper end surface of the upper track of the U-shaped scribing track 61 (see FIG. 20).

According to an embodiment, a portion of the clamping table 614 away from the bayonet 612 may have a slope and may be connected with at least a track disposed on the U-shaped scribing track 61. According to an embodiment, the hook 39 may be implemented on a vertical surface 1*a* of the first clip body 3.

Figure 7:
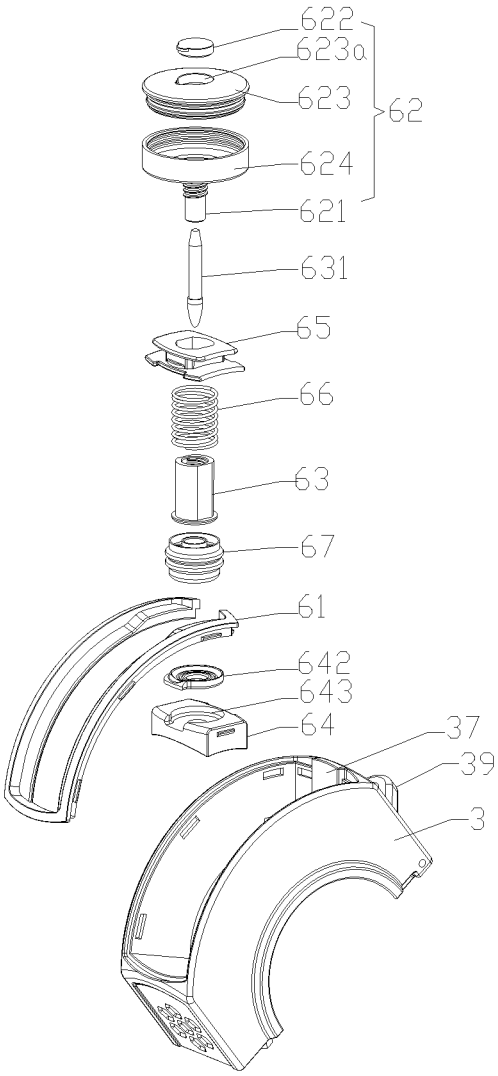
FIG. 7 is a schematic diagram illustrating an exploded view of a first clip body in accordance with embodiments of the present disclosure.

FIG. 7 is a schematic diagram illustrating an exploded view of a first clip body in accordance with embodiments of the present disclosure. The brush device 6 may include a U-shaped scribing track 61, a circular ink tank 62 associated with a cylinder 621, a pen case 63 associated with a pen core 631, and a sealing cover 64.

According to an embodiment, as illustrated in FIG. 7, the circular ink tank 62 having the cylinder 621, the U-shaped scribing track 61, the pen case 63 having the pen core 631, and the sealing cover 64 may be sequentially connected from top to bottom. The U-shaped scribing track 61 may be disposed and connected to the clip groove 31.

According to an embodiment, an upper part of the pen core 631 may pass through a cylinder 621 and enter the circular ink tank 62. A lower part of the pen core 631 may pass through the pen case 63 and enter a sealing cover 64 (e.g., the sealing cover may be configured and used for sealing).

According to an embodiment, the cylinder 621 may be disposed in the pen case 63. An upper part of the pen case 63 may pass through an I-shaped scribing guide sleeve 65 and may be adjacent to a lower end surface of the circular ink tank 62. A lower part of the pen case 63 may pass through a spring 66 and may be disposed at the upper end of the sealing cover 64. The sealing cover 64 may be disposed in the clip groove 31.

According to an embodiment, the I-shaped scribing guide sleeve 65 may be clamped on the U-shaped scribing track 61. Therefore, when the I-shaped scribing guide sleeve 65 slides on the U-shaped scribing track 61 to the scribing groove 331, the pen nib of the pen core 631 may pass through the scribing groove 331 to scribe or mark lines on the spherical surface of the golf ball 7.

Figure 8:
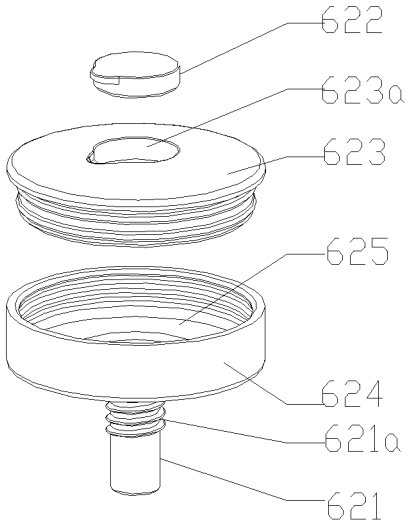
FIG. 8 is a schematic diagram illustrating an exploded view of a circular ink tank in accordance with embodiments of the present disclosure.

FIG. 8 is a schematic diagram illustrating an exploded view of a circular ink tank in accordance with embodiments of the present disclosure. According to an embodiment, the circular ink tank 62 includes a silicon strand plug 622, an ink tank cover 623 associated with a plug hole 623*a*, and an ink tank body 624.

According to an embodiment, the silicon strand plug 622 may be adapted to the plug hole 623*a*. For example, the silicon strand plug 622 may have a size that fits or matches with the hollow area disposed on an upper surface of the plug hole 623*a*. A lower part of the ink tank cover 623 may be screwed into the ink tank body 624, such that a first accommodating cavity 625 (used for accommodating ink) may be arranged between the ink box cover 623 and the ink tank body 624. The first accommodating cavity 625 may have ink stored inside that is used to scribe or mark lines on the golf ball 7. The cylinder 621 body may be connected to a bottom end surface of the ink tank body 624. An outer upper part of the cylinder 621 may be provided with an outer thread 621*a*. The upper end surface of that pen case 63 may be adjacent to a low end surface of the ink tank body 624.

According to an embodiment, both the ink box cover 623 and the ink tank body 624 are circular. The ink contained in the first accommodation cavity 625 may be a special ink for scribing golf ball 7. The ink is quickly dried after scribing on a surface (e.g., surface of a golf ball) and water cannot scrub the ink after the ink is used. When additional ink is added into the circular ink tank 62, the silicon strand plug 622 may be opened, and ink may be added into the first accommodation cavity 625 from the plug hole 623*a*, thus completing the replenishment of ink for the golf ball scriber.

Figure 9:
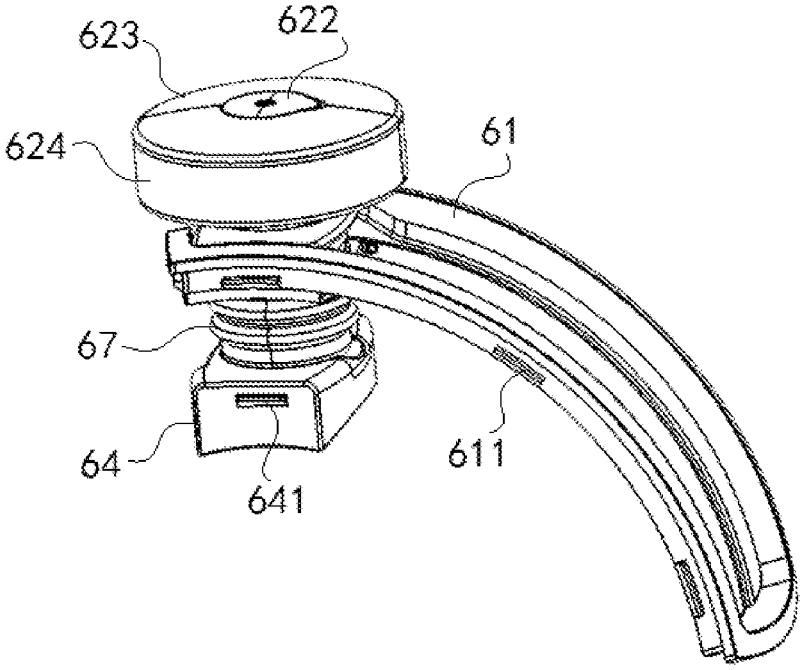
FIG. 9 is a schematic diagram illustrating a 3D structure of a sealed brush device in accordance with embodiments of the present disclosure.
Figure 10:
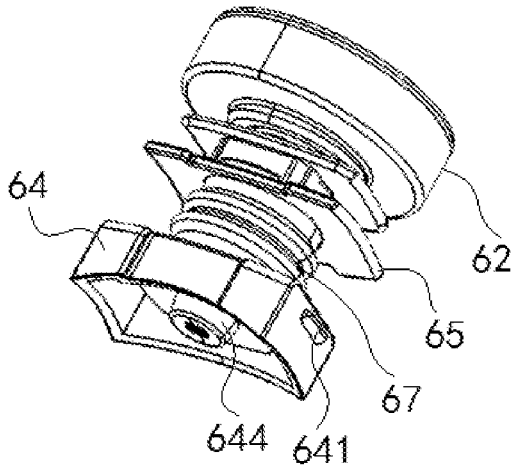
FIG. 10 is a schematic diagram of a 3D structure of a sealed brush device without a U-shaped scribing track implemented in accordance with embodiments of the present disclosure.

FIG. 9 is a schematic diagram illustrating a 3D structure of a sealed brush device in accordance with embodiments of the present disclosure. FIG. 10 is a schematic diagram of a 3D structure of a brush device without a U-shaped scribing track implemented therein in accordance with embodiments of the present disclosure. According to an embodiment, the circular ink tank 62 includes a silicon strand plug 622, an ink tank cover 623 associated with a plug hole 623*a*, and an ink tank body 624.

According to an embodiment, a No. 2 tenon 611 may be disposed on each of two outer walls of the U-shaped scribing track 61 along the radial direction of the clip 1. The No. 2 tenon 611 may be adapted to the No. 2 mortise 36.

According to an embodiment, as illustrated in FIG. 9, the brush device 6 may include a No. 2 sealing silicon strand 67, which is disposed at the upper part of the sealing cover 64. A No. 1 tenon 641 may be disposed on the sealing cover 64.

According to an embodiment, as illustrated in FIG. 10, the brush device 6 includes at least the circular ink tank 62, the I-shaped scribing guide sleeve 65, the No. 2 sealing silicon strand 67, the conical clamping cylinder 644, and the sealing cover 64. The sealing cover 64 may at least partially surround the conical clamping cylinder 644. The silicon strand groove 643 may be disposed on an upper end surface of the sealing cover 64. The silicon strand groove 643 may match with the No. 1 sealing silicon strand 642. The conical clamping cylinder 644 may be disposed in the silicon strand groove 643.

Figure 11:
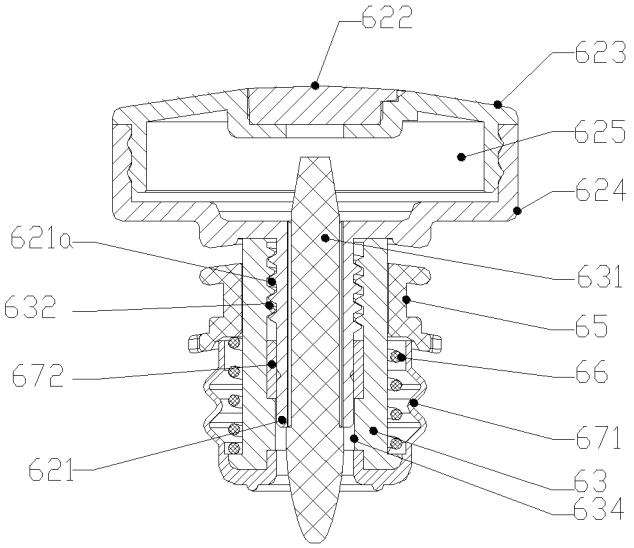
FIGS. 11 and 12 are schematic diagrams illustrating a cross-sectional view in different directions when a U-shaped scribing track is not installed in a brush device in accordance with embodiments of the present disclosure.
Figure 12:
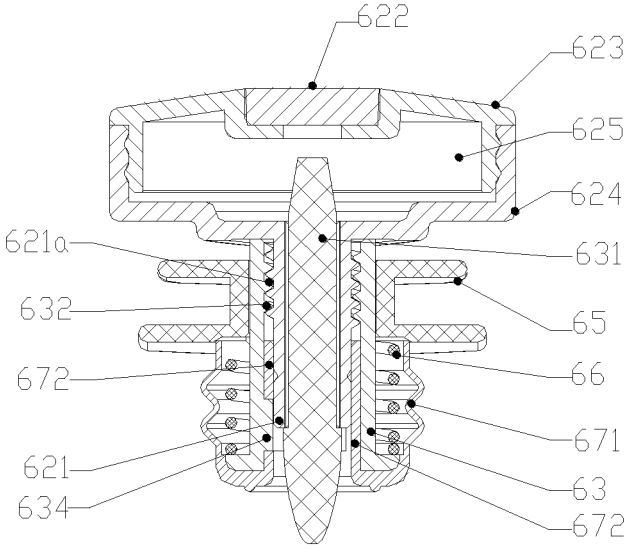

FIGS. 11 and 12 are schematic diagrams illustrating a cross-sectional view in different directions when a U-shaped scribing track is not yet installed in the brush device in accordance with embodiments of the present disclosure. According to an embodiment, the circular ink tank 62 includes a silicon strand plug 622, an ink tank cover 623 associated with a plug hole 623*a*, and an ink tank body 624.

According to an embodiment, the silicon strand plug 622 may be adapted to the plug hole 623*a*. For example, the silicon strand plug 622 may have a size that fits or matches with the hollow area disposed on an upper surface of the plug hole 623*a*. A lower part of the ink tank cover 623 may be screwed into the ink tank body 624, such that a first accommodating cavity 625 (used for accommodating ink) may be arranged between the ink box cover 623 and the ink tank body 624. The first accommodating cavity 625 may have ink stored inside that is used to scribe or mark line on the golf ball 7. The cylinder 621 body may be connected to a bottom end surface of the ink tank body 624. An outer upper part of the cylinder 621 may be provided with an outer thread 621*a*. The upper end surface of that pen case 63 may be adjacent to a low end surface of the ink tank body 624.

According to an embodiment, both the ink box cover 623 and the ink tank body 624 are circular. The ink contained in the first accommodation cavity 625 may include ink customized for scribing the spherical surface of the golf ball 7. The ink may be quickly dried after scribing on a surface (e.g., surface of a golf ball) and water cannot scrub the ink afterwards. When additional ink is added into the circular ink tank 62, the silicon strand plug 622 may be opened, and ink may be added into the first accommodation cavity 625 from the plug hole 623*a*, thus completing the replenishment of ink for the golf ball scriber.

Figure 13:
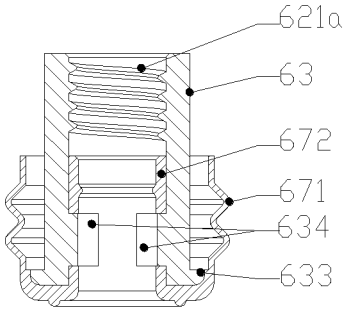
FIGS. 13 and 14 are schematic diagrams illustrating a cross-sectional view in different directions when a pen case is connected with a No. 2 sealing silicon strand in accordance with embodiments of the present disclosure.
Figure 14:
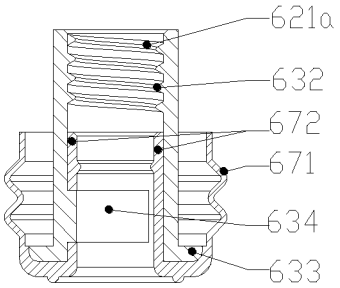

FIGS. 13 and 14 are schematic diagrams illustrating a cross-sectional view in different directions when a pen case is connected to a No. 2 sealing silicon strand in accordance with embodiments of the present disclosure. According to an embodiment, the inside of the pen case 63 may be configured to have a hollow cylindrical shape. An inner thread 632 may be disposed on the inner side wall of the upper part of the pen case 63. The inner thread 632 may be connected to the upper part of the cylinder 621. It increases the stability between the pen case 63 and the cylinder 621.

According to an embodiment, a circular limiting table 633 may be disposed on an outer wall of the lower part of the pen case 63. The circular limiting table 633 may be flush with the bottom end surface of the pen case 63. In this way, the lower part of the spring 66 is configured to be restrained on the circular limiting table 633.

When a user (e.g., a golf ball player) wants to scribe on the spherical surface of the golf ball 7, the brush device 6 may be lifted and may slide right above the scribing groove 331, and then the brush device 6 may be released. At this time, under the joint effects of the circular limiting table 633 and the I-shaped scribing guide sleeve 65, the spring 66 may be compressed, and the pen nib of the pen core 631 may pass through the I-shaped scribing guide sleeve 65 to scribe on the spherical surface of the golf ball 7 along the U-shaped scribing track 61.

Figure 15:
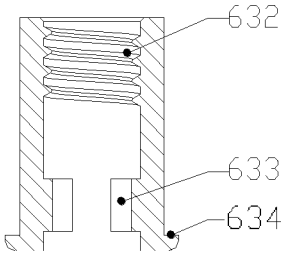
FIGS. 15 and 16 are schematic diagrams illustrating cross-sectional view of a pen case in different directions in accordance with embodiments of the present disclosure.
Figure 16:
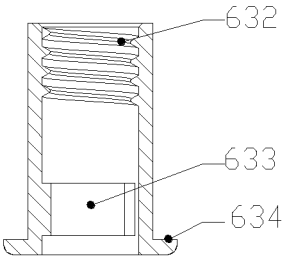

FIGS. 15 and 16 are schematic diagrams illustrating cross-sectional view of a pen case in different directions in accordance with embodiments of the present disclosure. As illustrated in FIG. 15, the pen case 63 includes at least the inner thread 632, the circular limiting table 633, and the arc-shaped bump 634. According to an embodiment, the inner thread 632 may be disposed above the circular limiting table 633. The arc-shaped bump 634 may at least partially surround the circular limiting table 633.

Figure 17:
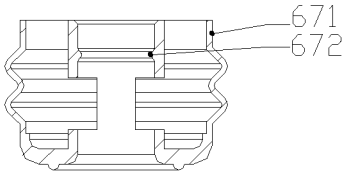
FIGS. 17 and 18 are schematic diagrams illustrating cross-sectional view of No. 2 sealing silicon strand in different directions in accordance with embodiments of the present disclosure.
Figure 18:
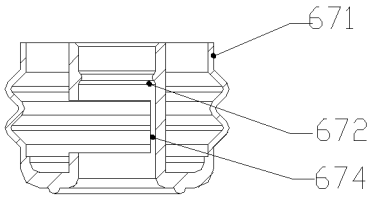

FIGS. 17 and 18 are schematic diagrams illustrating cross-sectional view of a No. 2 sealing silicon strand in different directions in accordance with embodiments of the present disclosure.

According to an embodiment, the brush device 6 may include the No. 2 sealing silicon strand 67, which is disposed at the upper part of the sealing cover 64. The No. 2 sealing silicon strand 67 may include an outer silicon strand body 671 and an inner silicon strand body 672. The inner silicon strand body 672 may be vertically arranged along the lower end of the outer silicon strand body 671 facing its interior.

According to an embodiment, the No. 2 accommodating cavity 673 may be configured to accommodate a lower part of the pen case 63. The No. 2 accommodating cavity 673 may be implemented between the outer silicon strand body 671 and the inner silicon strand body 672. The inner silicon strand body 672 may be figured to include a hollow structure and may be coaxial with the outer silicon strand body 671. The upper part of the inner silicon strand body 672 may be disposed between the cylinder 621 and the pen case 63. According to an embodiment, the pen core 631 may penetrate through the lower part of the inner silicon strand body 672 and enter the sealing cover 64 for sealing.

According to an embodiment, the pen core 631 may penetrate through the lower part of the inner silicon strand body 672 and enter the sealing cover 64 for sealing. The sealing performance of the pen case 63 is increased.

According to an embodiment, to further increase the sealing performance of the brush device 6, an arc-shaped opening 674 may be disposed in the inner silicon strand body 672 along its radial direction, and an arc-shaped bump 634 adapted to the arc-shaped opening 674 may be disposed on the inner wall of the pen case 63.

Figure 19:
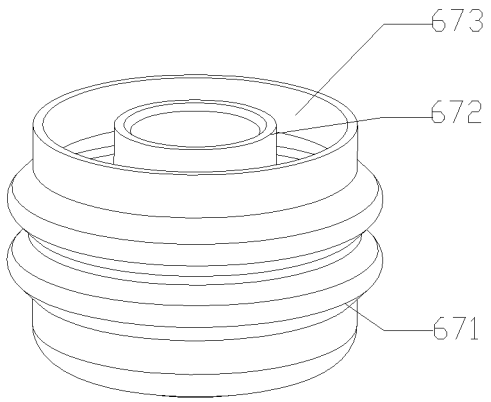
FIG. 19 is schematic diagram illustrating a 3D structure of a No. 2 sealing silicon strand in accordance with embodiments of the present disclosure.

FIG. 19 is schematic diagram illustrating a 3D structure of a No. 2 sealing silicon strand in accordance with embodiments of the present disclosure.

According to an embodiment, the brush device 6 may include the No. 2 sealing silicon strand 67, which is disposed at the upper part of the sealing cover 64. The No. 2 sealing silicon strand 67 may include an outer silicon strand body 671 and an inner silicon strand body 672. A No. 2 accommodating cavity 673 may be configured to accommodate a lower part of the pen case 63. The No. 2 accommodating cavity 673 may be implemented between the outer silicon strand body 671 and the inner silicon strand body 672. The inner silicon strand body 672 may be figured to include a hollow structure and may be coaxial with the outer silicon strand body 671. The upper part of the inner silicon strand body 672 may be disposed between the cylinder 621 and the pen case 63.

According to an embodiment, to further increase the sealing performance of the brush device 6, an arc-shaped opening 674 may be disposed in the inner silicon strand body 672 along its radial direction, and an arc-shaped bump 634 adapted to the arc-shaped opening 674 may be disposed on the inner wall of the pen case 63.

Figure 20:
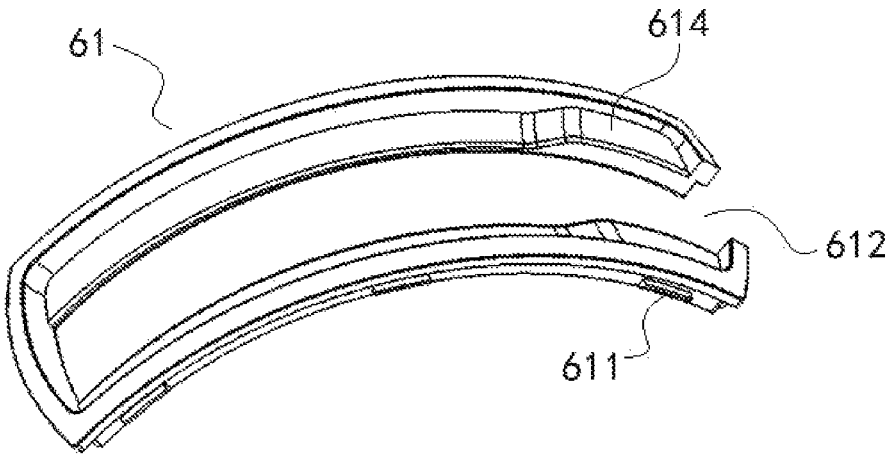
FIGS. 20 and 21 are schematic diagrams illustrating a 3D structure of a U-shaped scribing track in different directions in accordance with embodiments of the present disclosure.
Figure 21:
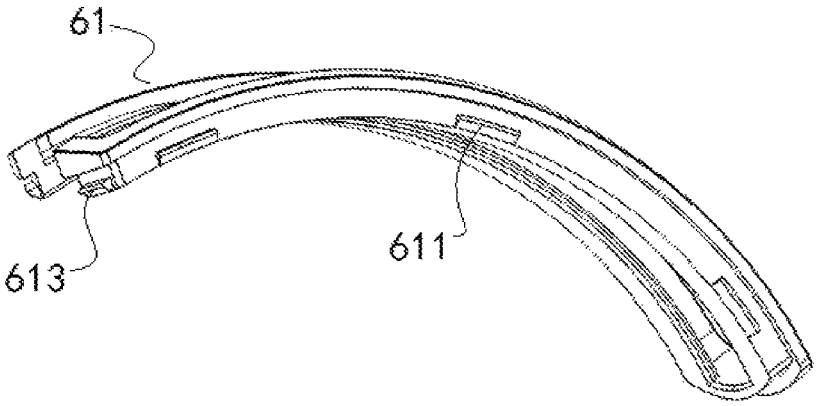

FIGS. 20 and 21 are schematic diagrams illustrating a 3D structure of a U-shaped scribing track in different directions/viewpoints in accordance with embodiments of the present disclosure. As illustrated in FIG. 20, a bulged part (i.e., a clamping table 614) may be arranged on one end of the U-shaped scribing track 61 near the bayonet 612. A height of the clamping table 614 may be higher than a height of the rest portion of the U-shaped scribing track 61. When the brush device 6 is at a sealing position (e.g., the brush device 6 is not yet used to scribe the golf ball 7 or the brush device 6 is back to the sealing position after scribing), a force may be exerted on the spring 66 and the spring 66 may be compressed due to the thickness of the clamping table 614. As a result, the No. 2 sealing silicon strand 67, a No. 1 sealing silicon strand 642, the sealing cover 64 may be compressed and sealed together in a perfect condition due the exerted force on the spring 66.

According to an embodiment, when the brush device 6 is at the sealing position, the I-shaped scribing guide sleeve 65 may be steady and stable due to the clamping table 614. As a result, the brush device 6 is stably docked at the sealing position.

According to an embodiment, the brush device 6 may move away from the clamping table 614. For example, the brush device 6 is used by a user to scribe or mark lines on spherical surface of the golf ball 7. The I-shaped scribing guide sleeve 65 may be spaced apart from the U-shaped scribing track 61. For example, a gap may exist between the I-shaped scribing guide sleeve 65 and the U-shaped scribing track 61. The brush device 6 may be loose and slide away from one end of the U-shaped scribing track 61. Therefore, the user can easily move the brush device 6 to scribe.

According to an embodiment, a No. 2 tenon 611 may be disposed on each of two outer walls of the U-shaped scribing track 61 along the radial direction of the clip 1. The No. 2 tenon 611 may be adapted to the No. 2 mortise 36. For example, a size/type of the No. 2 tenon 611 may match with a size/type of the No. 2 mortise 36. The No. 2 mortise 36 may be disposed at the upper part of the No. 1 mortise 35. In this way, the sealing cover 64 is located at the lower part of the U-shaped scribing track 61.

According to an embodiment, as illustrated in FIG. 20, the rails on both sides of the bayonet 612 maybe symmetrically provided with clamping tables 614 for clamping the I-shaped scribing guide sleeve 65. An upper end surface of the clamping table 614 may be higher than an upper end surface of the upper track of the U-shaped scribing track 61.

Figure 22:
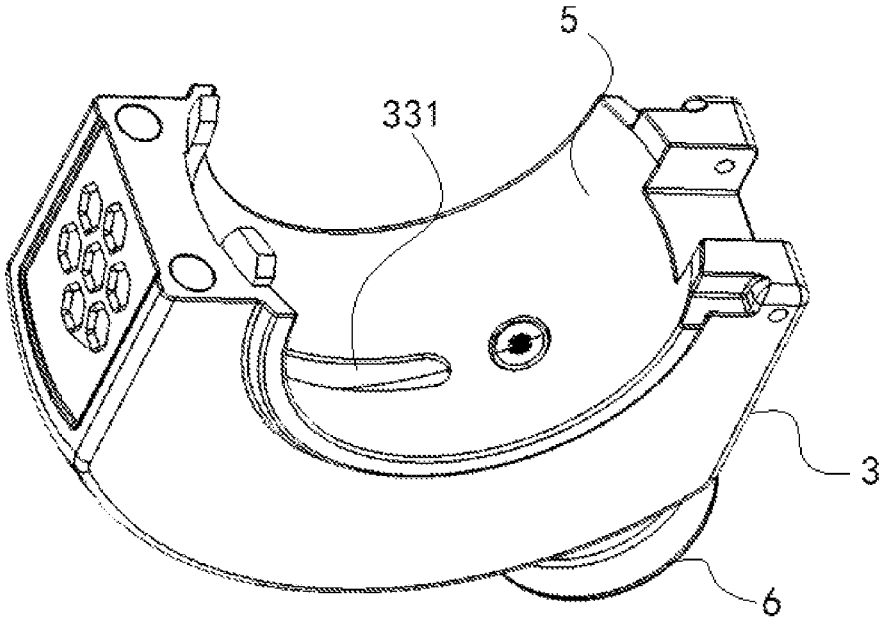
FIGS. 22 and 23 are schematic diagrams illustrating a 3D structure of a first clip body from different viewpoints in accordance with embodiments of the present disclosure.
Figure 23:
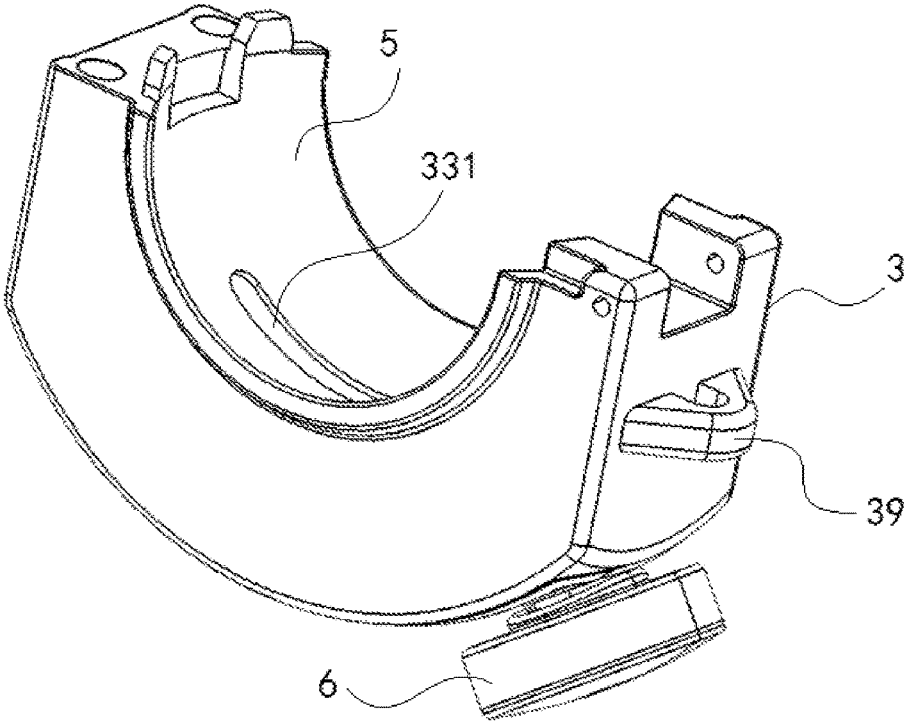

FIGS. 22 and 23 are schematic diagrams illustrating a 3D structure of a first clip body from different viewpoints in accordance with embodiments of the present disclosure. According to an embodiment, the golf ball scriber or the scribing device may include at least a first clip body 3 and a brush device 6. The scribing groove 331 may be disposed on the clamping groove surface 5, which is the inner wall of the first clip body 3.

According to an embodiment, the first clip body 3 may also include a hook 39. The hook 39 may be disposed on a side surface of the first clip body 3. Users may easily carry the golf ball scriber or the scribing device using the hook 39.

Figure 24:
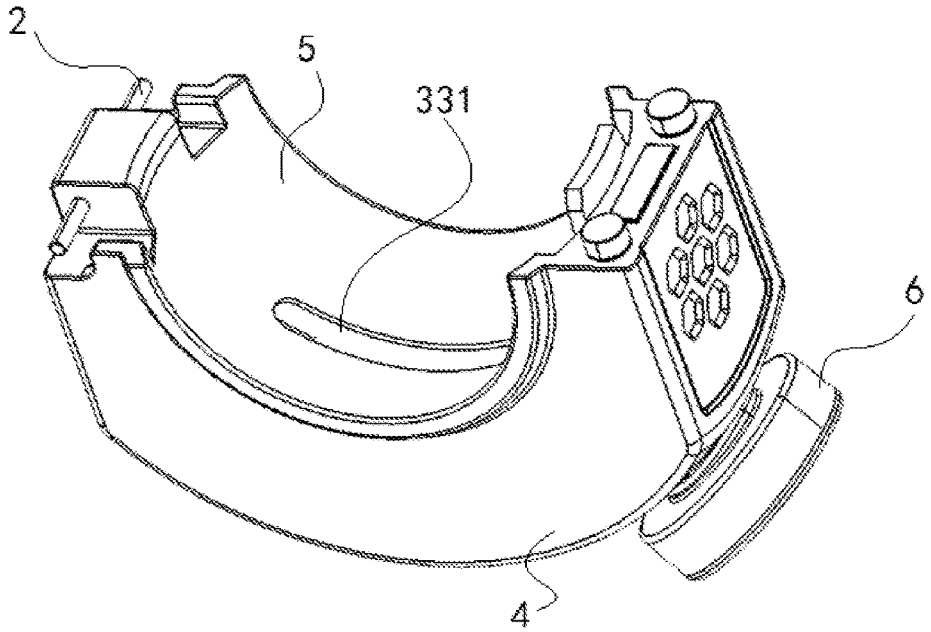
FIGS. 24 and 25 are schematic diagrams illustrating a 3D structure of a second clip body from different viewpoints in accordance with embodiments of the present disclosure.
Figure 25:
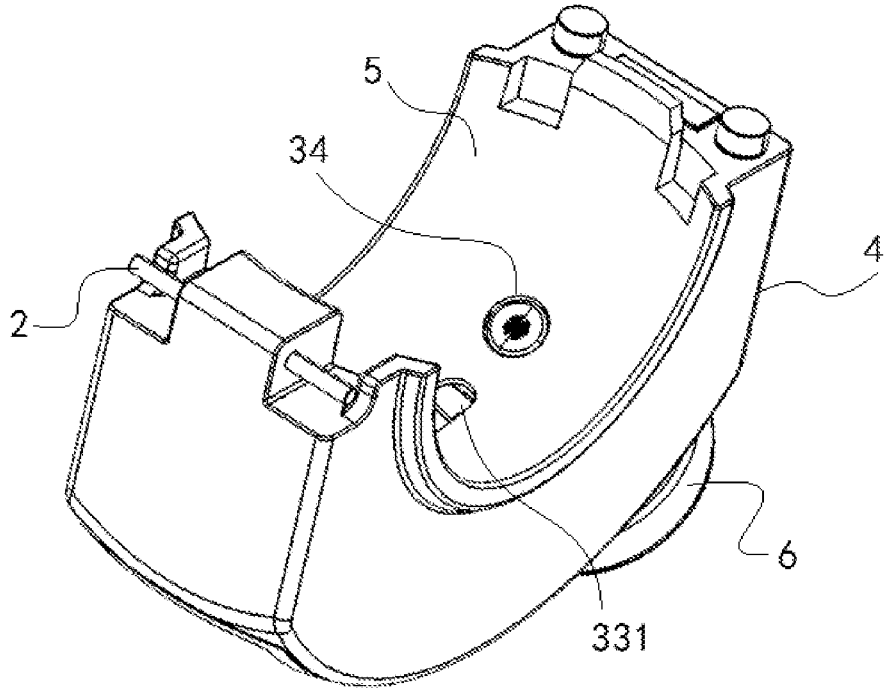

FIGS. 24 and 25 are schematic diagrams illustrating a 3D structure of a second clip body from different viewpoints in accordance with embodiments of the present disclosure. According to one or more embodiments, the second clip body 4 may have a substantially similar structure as the first clip body 3. The second clip body 4 may also include a pivot shaft 2, which is used to connect the second clip body 4 to the first clip body 3. A clamping hole 34 may be disposed on the clamping groove surface 5, which is the inner wall of the second clip body 4.

Figure 26:
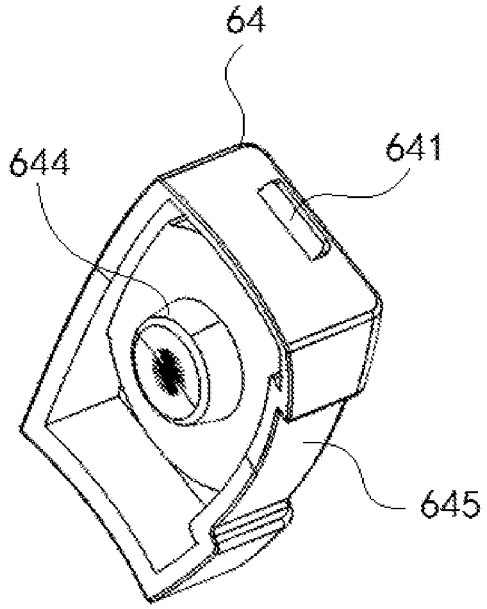
FIG. 26 is a schematic diagram illustrating a structure of a sealing cover in accordance with embodiments of the present disclosure.

FIG. 26 is a schematic diagram illustrating a structure of a sealing cover in accordance with embodiments of the present disclosure. According to an embodiment, the silicon strand groove 643 may be disposed on an upper end surface of the sealing cover 64. The silicon strand groove 643 may match with the No. 1 sealing silicon strand 642. The conical clamping cylinder 644 may be disposed in the silicon strand groove 643. The conical clamping cylinder 644 may match with the clamping hole 34. The bottom end surface of the conical clamping cylinder 644 may not be in contact with the spherical surface of the golf ball 7.

When the golf ball scriber is in a standby state, the pen nib of the pen core 631 may be placed in the conical clamping cylinder 644. According to an embodiment, there may be a gap between the pen nib of the pen core 631 and the inner bottom surface of the conical clamping cylinder 644. The gap distance may be about 2.5 mm to 3 mm. The pen core 631 can be sealed and kept in a moist state, and can be used directly and immediately when a user is ready to scribe a golf ball. According to some embodiments, the ink can be dried quickly and water cannot scrub the ink off. However, the ink is not dried out on the pen nib of the pen core 631 and can be reused for duration of time. As a result, the brush device, along with the pen nib, can be used for multiple times and for relatively long time.

According to one or more embodiments, unlike conventional technology separating the scribing pen (e.g., a brush device) from the scriber, a golf ball scriber of the present inventive concept integrates the brush device (e.g., the brush device is a part of the scriber). As a result, the scriber is more convenient to carry and more suitable for users to scribe or mark lines on a surface of a golf ball.

According to an embodiment, the clamping groove 645 may be arranged on one side of the sealing cover 64 which connects a side wall having the No. 3 mortise 38. The clamping groove 645 may be adapted to the lower part of the clamping block 37. For example, a size/type of the clamping groove 645 may match with a size/type of the lower part of the clamping block 37 (see FIG. 26). As a result, the stability of the connection between the sealing cover 64 and the clip groove 31 is maintained. In the meantime, the overall connectivity performance between the sealing cover 64 and the clip groove 31 is increased.

An example process of operating the scriber is described below with reference to FIGS. 1-26. According to one or more embodiments, when the scriber is in a standby state, the clip 1 and the brush device 6 may be integrated. At this time, under the semi-compression of the spring 66, the pen core 631 may be pressed against the sealing cover 64 to form a complete sealing system.

When the scriber is at working condition, firstly, the golf ball 7 is put into the clamping groove surface 5 of the clip 1, and a person who uses the scriber (i.e., a user) can select the scribing position according to personal habits. For example, the spherical surface of the golf ball 7 may be exposed on both sides (FIG. 3) and the golf ball 7 may be rotated inside the clip 1 before the user scribes. In the meantime, the user can gaze at the spherical surface from the scribing groove 331 and the user may select a suitable position for scribing.

According to one or more embodiments, the circular ink tank 62 is lifted by hand. At this time, due to the cooperative action of the I-shaped scribing guide sleeve 65 and the sealing cover 64, the spring 66 is in a fully compressed state after contraction, and the pen core 631 is lifted from the sealing cover 64 and moves to the side of the U-shaped scribing track 61. When the pen core 631 corresponds to the scribing groove 331 and needs to be scribed, the circular ink tank 62 may be released. At this time, the spring 66 may press down the brush device 6, and the spring 66 is in an extended state, so that the pen nib of the pen core 631 may be in contact with the spherical surface of the golf ball 7 for scribing or marking lines on a golf ball. During the scribing process, due to the design of the chamfered groove 33, friction on the No. 2 sealing silicon strand 67 is reduced, and its duration of service is increased.

While the inventive concept has been particularly shown and described with reference to the example embodiments thereof, it will be understood by one of ordinary skill in the art that variations in form and detail may be made therein without departing from the spirit and scope of the inventive concept.

What is claimed is:

1. A golf ball scriber, comprising:

a clip comprising a first clip body and a second clip body which are connected by a pivot shaft;

a clamping groove surface disposed on an inner clamping surface of the clip;

a sealed brush device;

a first clip groove and a second clip groove symmetrically arranged on a respective outer wall of the first clip body and the second clip body;

a scribing ruler disposed at a bottom surface of the first clip groove;

a chamfered groove disposed on the scribing ruler away from the clamping groove surface along a radial direction of the clip, wherein the chamfered groove is strip-shaped; and a scribing groove disposed on the chamfered groove which corresponds to the clamping groove surface, wherein the scribing groove is strip-shaped, wherein the scribing ruler, the chamfered groove, and the scribing groove share a central line, and wherein the sealed brush device is in sliding connection with the first clip groove disposed on the first clip body.

2. The golf ball scriber of claim 1, wherein the sealed brush device comprises:

a U-shaped scribing track, a circular ink tank having a cylinder, a pen case having a pen core, a sealing cover, wherein the circular ink tank, the U-shaped scribing track, the pen case, and the sealing cover are sequentially connected from top to bottom of the sealed brush device, and wherein the U-shaped scribing track is connected to the first clip groove;

an upper part of the pen core configured to pass through the cylinder and enter the circular ink tank; and a lower part of the pen core configured to pass through the pen case and enter the sealing cover for sealing.

3. The golf ball scriber of claim 2, further comprising:

an I-shaped scribing guide sleeve; and a spring, wherein the cylinder is disposed in the pen case and an upper part of the pen case passes through the I-shaped scribing guide sleeve and is adjacent to a lower end surface of the circular ink tank, wherein a lower part of the pen case passes through the spring and is disposed at an upper end of the sealing cover, wherein the sealing cover is disposed in the first clip groove, and the I-shaped scribing guide sleeve is clamped on the U-shaped scribing track, and wherein as the I-shaped scribing guide sleeve slides on the U-shaped scribing track to the scribing groove, a pen nib of the pen core passes through the scribing groove to scribe a spherical surface of a golf ball.

4. The golf ball scriber of claim 3, further comprising:

a clamping hole;

a No. 1 mortise; and a No. 1 tenon, wherein the clamping hole clamped with the sealing cover is disposed at the bottom surface of the first clip groove, and the clamping hole is located at one end of the chamfered groove, wherein the clamping hole and the chamfered groove share the central line, wherein the No. 1 mortise is disposed on each of two symmetrical side walls in the first clip groove along an axial direction of the clip, and wherein the No. 1 mortise is adapted to the No. 1 tenon disposed on the sealing cover.

5. The golf ball scriber of claim 4, further comprising:

at least two No. 2 mortises;

a No. 2 tenon;

a clamping block; and a No. 3 tenon, wherein the at least two No. 2 mortises arranged at equal intervals are disposed on each of two symmetrical side walls in the first clip groove along the axial direction of the clip, wherein the at least two No. 2 mortises are arranged along the radial direction of the clip, wherein the No. 2 tenon is disposed on each of two outer walls of the U-shaped scribing track along the radial direction of the clip, and the No. 2 tenon is adapted to each of the at least two No. 2 mortises, wherein the clamping block is arranged in the middle of a side wall of the clamping hole in the first clip groove, and a No. 3 mortise is symmetrically arranged at both ends of the clamping block, and wherein the clamping block is clamped in a bayonet of the U-shaped scribing track, and the No. 3 tenon is symmetrically arranged at both ends of the bayonet on the U-shaped scribing track, and the No. 3 tenon is adapted to the No. 3 mortise.

6. The golf ball scriber of claim 5, further comprises a clamping groove, wherein the clamping groove is disposed on a side surface of the sealing cover which connects a side wall having the No. 3 mortise, and wherein the clamping groove is adapted to a lower part of the clamping block.

7. The golf ball scriber of claim 4, further comprising:

a silicon strand groove;

a No. 1 sealing silicon strand; and a conical clamping cylinder, wherein the silicon strand groove is disposed on an upper end surface of the sealing cover and the silicon strand groove is adapted to the No. 1 sealing silicon strand, and wherein the conical clamping cylinder is disposed in the silicon strand groove and the conical clamping cylinder is adapted to the clamping hole.

8. The golf ball scriber of claim 3, wherein the circular ink tank comprises a silicon strand plug, an ink box cover having a plug hole, an ink tank body, and the silicon strand plug is adapted to the plug hole, wherein a lower part of an ink tank cover is configured to be screwed into the ink tank body, and a No. 1 accommodating cavity configured to accommodate ink is formed between the ink box cover and the ink tank body, wherein the cylinder is connected to and communicates with the bottom end surface of the ink tank body, and an outer upper part of the cylinder is provided with an outer thread, and wherein an upper end surface of the pen case is disposed adjacent to a low end surface of the ink tank body.

9. The golf ball scriber of claim 8, further comprising:

a circular limiting table, wherein the pen case is configured to be hollow cylindrical inside, and an inner thread connected with an upper thread of the cylinder is disposed on an inner wall of the upper part of the pen case, wherein the circular limiting table is disposed on an outer wall of the lower part of the pen case and the circular limiting table is flush with a bottom end surface of the pen case, and wherein a lower part of the spring is configured to be restrained on the circular limiting table.

10. The golf ball scriber of claim 1, wherein the sealed brush device comprises a U-shaped scribing track and a clamping table, and wherein the clamping table is disposed on one end of the U-shaped scribing track.

11. The golf ball scriber of claim 10, wherein a height of the clamping table is higher than a height of a portion of the U-shaped scribing track.

12. A golf ball scriber, comprising:

a clip comprising a first clip body and a second clip body which are connected by a pivot shaft;

a clamping groove surface disposed on an inner clamping surface of the clip;

a sealed brush device, wherein the sealed brush device is connected to the first clip body; and a first clip groove and a second clip groove symmetrically arranged on a respective outer wall of the first clip body and the second clip body, wherein the sealed brush device is in sliding connection with the first clip groove disposed on the first clip body, wherein the sealed brush device comprises a U-shaped scribing track and a clamping table, and wherein the clamping table is disposed on one end of the U-shaped scribing track.

13. The golf ball scriber of claim 12, further comprising:

a scribing ruler disposed at a bottom surface of the first clip groove;

a chamfered groove disposed on the scribing ruler away from the clamping groove surface along a radial direction of the clip, wherein the chamfered groove is strip-shaped; and a scribing groove disposed on the chamfered groove which corresponds to the clamping groove surface, wherein the scribing groove is strip-shaped.

14. The golf ball scriber of claim 13, wherein the scribing ruler, the chamfered groove, and the scribing groove share a central line, and wherein the sealed brush device includes a No. 2 sealing silicon strand disposed on an upper part of a sealing cover, and the No. 2 sealing silicon strand comprises an outer silicon strand body and an inner silicon strand body.

15. The golf ball scriber of claim 14, further comprising:

a No. 2 accommodating cavity;

a pen case including a pen core; and a circular ink tank including a cylinder, wherein the inner silicon strand body is vertically arranged along a lower end of the outer silicon strand body facing its interior, wherein the No. 2 accommodating cavity configured to accommodate a lower part of the pen case is disposed between the outer silicon strand body and the inner silicon strand body, wherein the inner silicon strand body is configured a hollow structure and is configured coaxial with the outer silicon strand body, and an upper part of the inner silicon strand body is disposed between the cylinder and the pen case, and wherein the pen core penetrates through the lower part of the inner silicon strand body and enters the sealing cover for sealing.

16. The golf ball scriber of claim 15, further comprising:

an arc-shaped opening; and an arc-shaped bump, wherein the arc-shaped opening is disposed in the inner silicon strand body along its radial direction, and the arc-shaped bump is disposed on an inner wall of the pen case and the arc-shaped bump is adapted to the arc-shaped opening.

17. A brush device, comprising:

a U-shaped scribing track, a circular ink tank having a cylinder, a pen case having a pen core, a sealing cover, wherein the circular ink tank, the U-shaped scribing track, the pen case, and the sealing cover are sequentially connected from top to bottom of the brush device;

an upper part of the pen core configured to pass through the cylinder and enter the circular ink tank; and a lower part of the pen core configured to pass through the pen case and enter the sealing cover for sealing.

18. The brush device of claim 17, further comprising:

an I-shaped scribing guide sleeve; and a spring, wherein the cylinder is disposed in the pen case and an upper part of the pen case passes through the I-shaped scribing guide sleeve and is adjacent to a lower end surface of the circular ink tank, wherein a lower part of the pen case passes through the spring and is disposed at an upper end of the sealing cover, and wherein the I-shaped scribing guide sleeve is clamped on the U-shaped scribing track.

* * * * *